US005147216A

United States Patent [19]

Shotey

[11] Patent Number: 5,147,216

[45] Date of Patent: Sep. 15, 1992

[54] SHROUD FOR IN-LINE ELECTRICAL PLUG

[76] Inventor: Michael J. Shotey, 7733 E. Cypress, Scottsdale, Ariz. 85257

[21] Appl. No.: 596,781

[22] Filed: Oct. 12, 1990

[51] Int. Cl.[5] ..... H01R 13/52

[52] U.S. Cl. ..... 439/367; 174/138 F; 439/369; 439/371; 439/521

[58] Field of Search ..... 439/367, 369, 371, 521, 439/892; 174/138 F

[56] References Cited

U.S. PATENT DOCUMENTS 4,869,683 9/1989 Nelson ..... 439/367

*Primary Examiner*—Paula A. Bradley

*Attorney, Agent, or Firm*—Cahill, Sutton & Thomas

[57] ABSTRACT

A flexible water resistant clindrical sheath encircles an in-line electrical connector to protect it against creating an electrical hazard. Opposed ends of the sheath are closed about respective electrical conductors extending from the in-line connector to enclose the in-line connector.

7 Claims, 1 Drawing Sheet

SHROUD FOR IN-LINE ELECTRICAL PLUG

BACKGROUND OF THE INVENTION

1. Field of the Invention

The present invention relates to devices for protecting against electrical hazards and, more particularly, to a shroud for enclosing an in-line electrical plug and socket.

2. Description of Related Art

Extension cords are used both domestically and commercially to provide electric power at a location remote from an electrical wall socket or similar source of electrical power. The electrical plug and mating socket at the terminal end of an electrical extension cord usually lies upon the ground. If there are puddles in the area proximate the electrical plug and socket, an obvious safety hazard would be presented were the electrical plug and socket drawn to or fall into the puddle. Similarly, a rain shower could wet an exposed electrical plug and socket to a degree sufficient to pose a hazard. Where a plurality of electrical extension cords are attached serially, each electrical plug and socket unit presents a potential hazard.

Partial disengagement of an electrical plug and socket will expose the prongs of the plug even though they may still be electrically connected to the socket. Such exposure increases the potential hazard in that access is provided for numerous types of electrical conducting elements to come into contact with the electrically charged prongs. Such contact poses yet further hazards.

Various devices have been developed for enclosing an electrical plug with a mated socket. Such devices are of rigid construction to physically protect the plug and socket unit. Some of these devices include elaborate sealing elements for precluding inflow of water. Numerous devices have also been developed for lockingly retaining an electrical plug mated with a socket to prevent separation therebetween. Some of these devices prevent any displacement between the electrical plug and socket while others primarily prevent disengagement to maintain electrical contact. The primary purpose of these devices is that of preventing disengagement with a secondary benefit of reducing the likelihood of exposed electrically charged prongs.

SUMMARY OF THE INVENTION

A flexible water resistant or impermeable sheath includes opposed openings for inserting and withdrawing an electrical plug and socket unit and attached conductors. A closure device is disposed at each end of the sheath to secure the sheath water tight about the respective extending conductor. The flexibility of the sheath permits accommodation of any size or configuration of plug and socket provided only that the width of the sheath is sufficient to wrap therearound. Retainer means may be employed to mechanically preclude separation of the in-line electrical plug and socket.

It is therefore a primary object of the present invention to provide a water tight flexible sheath for enclosing an in-line electrical connector.

Another object of the present invention is to provide a sheath having closable end openings for accommodating insertion and withdrawal of an electrical unit disposed intermediate extending electrical conductors.

Still another object of the present invention is to provide an electrical sheath extending about an electrical plug and electrical socket and secured to opposed extending electrical conductors.

A further object of the present invention is to provide a flexible light weight and inexpensive sheath for protecting in-line electrical conductors.

A still further object of the present invention is to provide an inexpensive disposable water tight sheath for various sized in-line electrical conductors.

A yet further object of the present invention is to provide a method for protecting in-line electrical connectors from creating a hazard.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

Description of the Preferred Embodiment

Extension cords are often used at construction sites for commercial purposes and by consumers to provide electrical power at a location distant from an electrical socket. Sometimes such cords must be used during inclement weather or in areas having water puddles or damp ground. The presence of water in and about each in-line electrical connector of an electrical extension cord presents an obvious safety hazard to both equipment and personnel.

Figure 1:
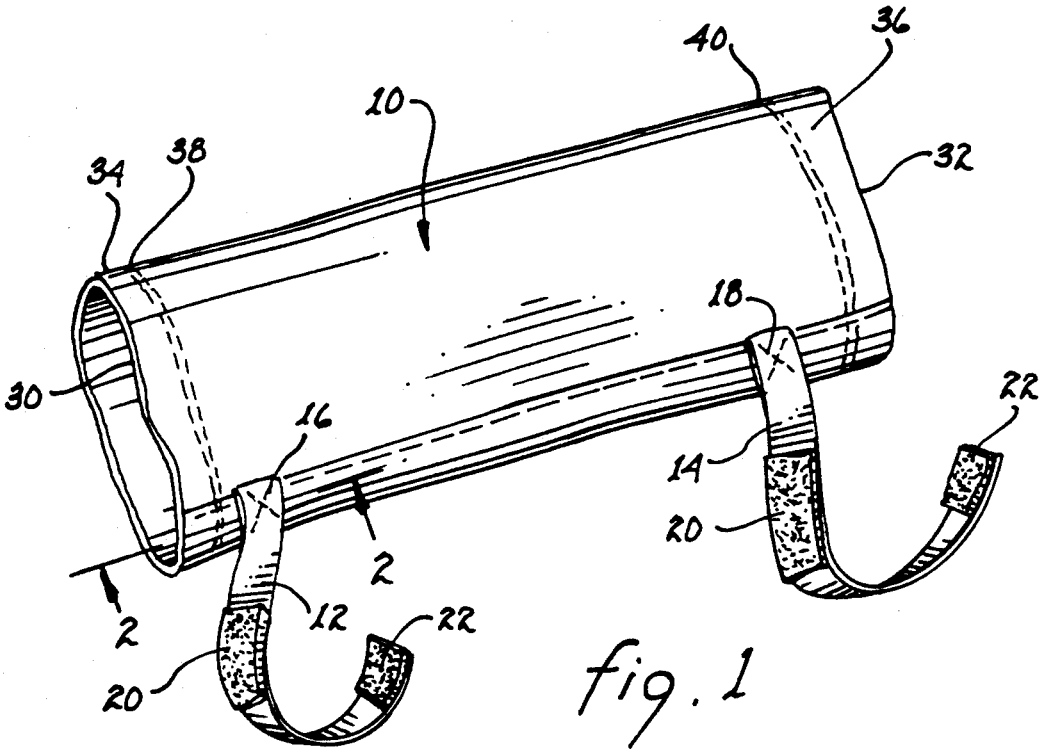
FIG. 1 depicts a perspective view of the sheath.
Figure 2:
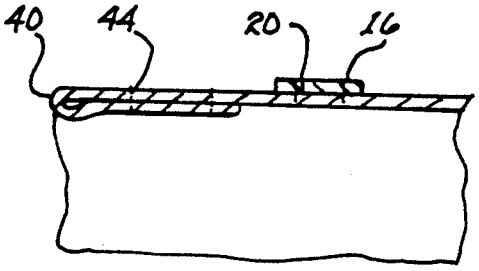
FIG. 2 is a partial cross sectional view taken along lines 2—2, as shown in FIG. 1.
Figure 3:
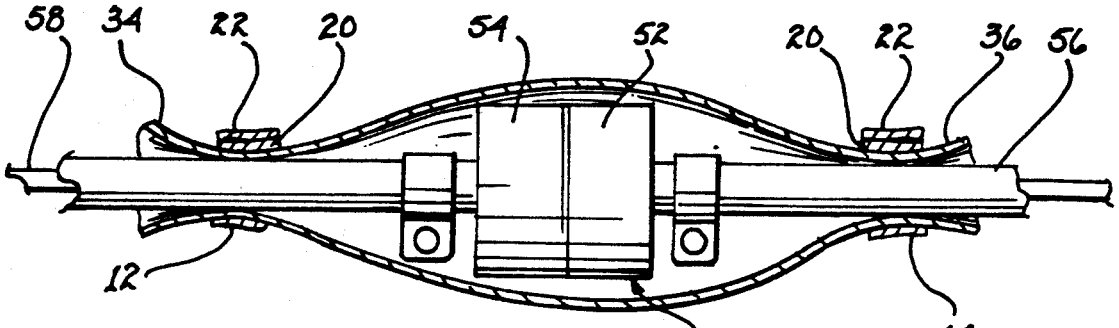
FIG. 3 illustrates the sheath mounted about an in-line electrical connector.

Referring jointly to FIGS. 1, 2 and 3, a sheath 10 will be described which effectively encapsulates and protects an in-line electrical connector against incursion of fluids and solid contaminants that may give rise to an electrical hazard. The sheath is formed of water tight or water impervious flexible material and serves as a shield to prevent fluid flow therethrough. Sheath 10 is cylindrical and of a diameter sufficient to enclose the in-line electrical connector to be protected. A pair of straps 12, 14 are secured to the sheath by means of stitching 16, 18, or the like. Each of the straps includes hook and loop fastening means 20, 22 respectively, which may be of the type sold under the trademark Velcro. Edges 30, 32 at ends 34, 36 of sheath 10 may be folded under and stitched by stitches 38, 40. Numeral 44 shown in FIG. 2 references the stitches extending through the folded over material. The resulting double thickness provides strength and robustness to the edges of the sheath.

In operation, an electrical in-line connector 50 includes a conventional plug 52 mated with a socket 54. Electrical conductors 56, 58 extend in opposed directions from the in-line connector.

Prior to mating the plug with the socket, sheath 10 is slipped onto one of the conductors. Thereafter the socket and plug are mated. The sheath is then translated along the in-line connector to position the in-line connector at the approximate midpoint of the sheath, as illustrated in FIG. 3. End 34 is bunched or crimped about conductor 58 and strap 12 is wrapped thereabout to secure the end tightly about the conductor. The strap is maintained wrapped by engagement between fastening means 20, 22. Similarly, end 36 is bunched or crimped about conductor 56 and strap 14 is wrapped thereabout to maintain the end tightly about the conductor. This strap is also maintained in place by fastening means 20, 22.

To disconnect in-line connector 50, straps 12 and 14 are unfastened from about their respective ends and sheath 10 is slid onto a conductor to expose the in-line connector. Plug 54 may then be disengaged from socket 52. The sheath may now be slid off the conductor and the respective plug/socket.

By forming sheath 10 of water resistant or water impervious material, in-line connector 50 is protected from the normally expected water hazards present outdoors. Moreover, it will also protect an in-line connector when used indoors in proximity to damp or water filled basements and other areas where water may be standing or sprayed. Because sheath 10 is of fabric, it may be readily folded or crumpled into a small volume suitable for being carried in the pocket of a workman or within a very small space in the workman's tool chest. Thus, it can be readily carried to and from the work place. The construction of sheath 10 is relatively simple and inexpensive and the material necessary is readily available from many sources; this material is sometimes referred to as rip stop material or parachute cloth.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for protecting an in-line electrical connector, said apparatus comprising in combination:

a) a sheath of flexible water resistant material having a longitudinal axis and a lateral axis for encircling the in-line electrical connector and for accommodating protrusions of electrical conductors extending from the in-line connector, said sheath including opposed first and second longitudinal edges permanently attached to one another to form a closed longitudinal wall of uniform water resistance and defining said sheath;

b) first means for closing one end of said sheath; and c) second means for closing the other end of said sheath to enclose the in-line connector within said sheath.

2. The apparatus as set forth in claim 1 wherein said first closing means comprises a strap and means for securing said strap to itself.

3. The apparatus as set forth in claim 1 wherein one of the electrical conductors extends from said one end and the other of the electrical conductors extends from said other end.

4. The apparatus as set forth in claim 3 wherein said sheath is cylindrical.

5. The apparatus as set forth in claim 1 wherein said second closing means comprises a strap and means for securing said strap to itself.

6. The apparatus as set forth in claim 5 wherein said first closing means comprises a further strap and further means for securing said further strap to itself.

7. The apparatus as set forth in claim 6 wherein each of said securing means and said further securing means comprises hook and loop fastening means.

* * * * *